US008894450B2

(12) United States Patent
Kitajima et al.

(10) Patent No.: US 8,894,450 B2
(45) Date of Patent: Nov. 25, 2014

(54) CONNECTOR HAVING A TERMINAL RETAINER WITH PRESSING MEANS

(71) Applicant: Sumitomo Wiring Systems, Ltd., Yokkaichi (JP)

(72) Inventors: Mitsunori Kitajima, Yokkaichi (JP); Toshikazu Sakurai, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 13/803,001

(22) Filed: Mar. 14, 2013

(65) Prior Publication Data

US 2013/0273764 A1 Oct. 17, 2013

(30) Foreign Application Priority Data

Apr. 11, 2012 (JP) ..... 2012-090483

(51) Int. Cl.
*H01R 13/514* (2006.01)
*H01R 13/436* (2006.01)
*H01R 13/62* (2006.01)

(52) U.S. Cl.
CPC ..... *H01R 13/62* (2013.01); *H01R 13/4362* (2013.01)
USPC ..... 439/752

(58) Field of Classification Search
CPC ..... H01R 13/639
See application file for complete search history.

(56) References Cited

U.S. PATENT DOCUMENTS

| | | | | |
|---|---|---|---|---|
| 6,390,859 | B2 * | 5/2002 | Furutani | 439/752 |
| 7,056,159 | B2 * | 6/2006 | Fukatsu et al. | 439/752 |
| 2003/0096539 | A1 * | 5/2003 | Ichio | 439/752 |

FOREIGN PATENT DOCUMENTS

JP 11-167948 6/1999

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A connector (10) includes a retainer (30) made of synthetic resin for mounting in a housing (11) at a partial locking position for permitting the insertion of a terminal fitting (20) into the housing (11) and at a full locking position for retaining the inserted terminal fitting (20). Locks (16, 35) are formed on the housing (11) and the retainer (30) and are engageable to hold the retainer (30) at the partial locking position. A pressure receiving surface (15) is formed on the housing (11) and is configured to restrict a movement of the retainer (30) toward the full locking position by pressing the retainer (30) in directions intersecting a moving direction of the retainer (30) from the partial locking position to the full locking position when the retainer (30) is at the partial locking position.

12 Claims, 13 Drawing Sheets

CONNECTOR HAVING A TERMINAL RETAINER WITH PRESSING MEANS

BACKGROUND OF THE INVENTION

1. Field of the Invention

The invention relates to a connector.

2. Description of the Related Art

Japanese Unexamined Patent Publication No. H11-167948 discloses a connector including a housing, a terminal fitting to be inserted into the housing and a retainer to be mounted at a partial locking position and a full locking position in the housing. The retainer mounted at the partial locking position is retracted to a position where the terminal fitting can be inserted into the housing. When the retainer then can be pushed from the partial locking position to the full locking position where the retainer engages the terminal fitting to retain and hold the terminal fitting.

The retainer is held at the partial locking position in the housing during transportation to a site where the terminal fitting is inserted. Hence, it is necessary to prevent the retainer from moving to the full locking position during the transportation. Engageable locking structures are provided on the housing and the retainer to hold the retainer at the partial locking position and to prevent inadvertent movement of the retainer to the full locking position.

A large engagement margin of the locking structures on the housing and the retainer arguably would hold the retainer reliably at the partial locking position. However, a large engagement margin increases the amount of resilient deformation of the housing or the retainer in the engaging process and a pressing force on the locking structures increases due to a resilient restoring force of the deformed housing or retainer. A large pressing force may plastically deform and squash the locking structure, thereby reducing the engagement margin between the locking structures and hence reducing a force for holding the retainer at the partial locking position.

The invention was completed based on the above situation and an object thereof is to increase a holding force for holding a retainer at a partial locking position.

SUMMARY OF THE INVENTION

The invention is directed to a connector, comprising a housing made of synthetic resin; a terminal fitting to be inserted into the housing; a retainer made of synthetic resin. The retainer can be mounted in the housing at a partial locking position or a full locking position. The terminal fitting can be inserted into or withdrawn from the housing when the retainer is at the partial locking position. However, the retainer that has been moved to a full locking position will retain the terminal fitting that has been inserted properly. Locking means are formed in or on the housing and the retainer and are configured to engage one another to hold the retainer at the partial locking position. Pressing means are formed in or on the housing and the retainer and are configured to restrict a movement of the retainer toward the full locking position by pressing each other in directions intersecting a moving direction of the retainer from the partial locking position to the full locking position when the retainer is at the partial locking position.

The pressing action of the pressing means generates a frictional resistance on the retainer when the retainer is at the partial locking position and restricts movement of the retainer toward the full locking position. The combination of the pressing means and the locking means provides an excellent holding force for holding the retainer at the partial locking position.

The pressing means of the connector may define a full locking projection that is configured to engage the housing and to hold the retainer at the full locking position. Thus, the shape of the retainer can be simplified as compared with a case where a dedicated means for holding the retainer at the full locking position is provided separately from the pressing means.

The retainer may include a main portion with a retaining portion for engaging and retaining the terminal fitting and a narrow portion formed with the pressing means. The narrow portion is narrower than the main portion in a direction substantially parallel to pressing directions of the pressing means. As a result, only a small amount of deformation will occur when a pressing force acts in a width direction. Thus, frictional resistance created between the housing and the retainer by the pressing of the pressing means is higher as compared with the case where the pressing means is formed on the main portion. Therefore, the retainer is held at the full locking position with a larger force.

DETAILED DESCRIPTION OF THE PREFERRED EMBODIMENTS

A connector 10 in accordance with the illustrated embodiment of the invention includes a housing 11 made of synthetic resin, terminal fittings 20 to be inserted into the housing 11 and a retainer 30 made of synthetic resin and to be selectively mounted at a partial locking position and a full locking position in the housing 11.

Figure 1:
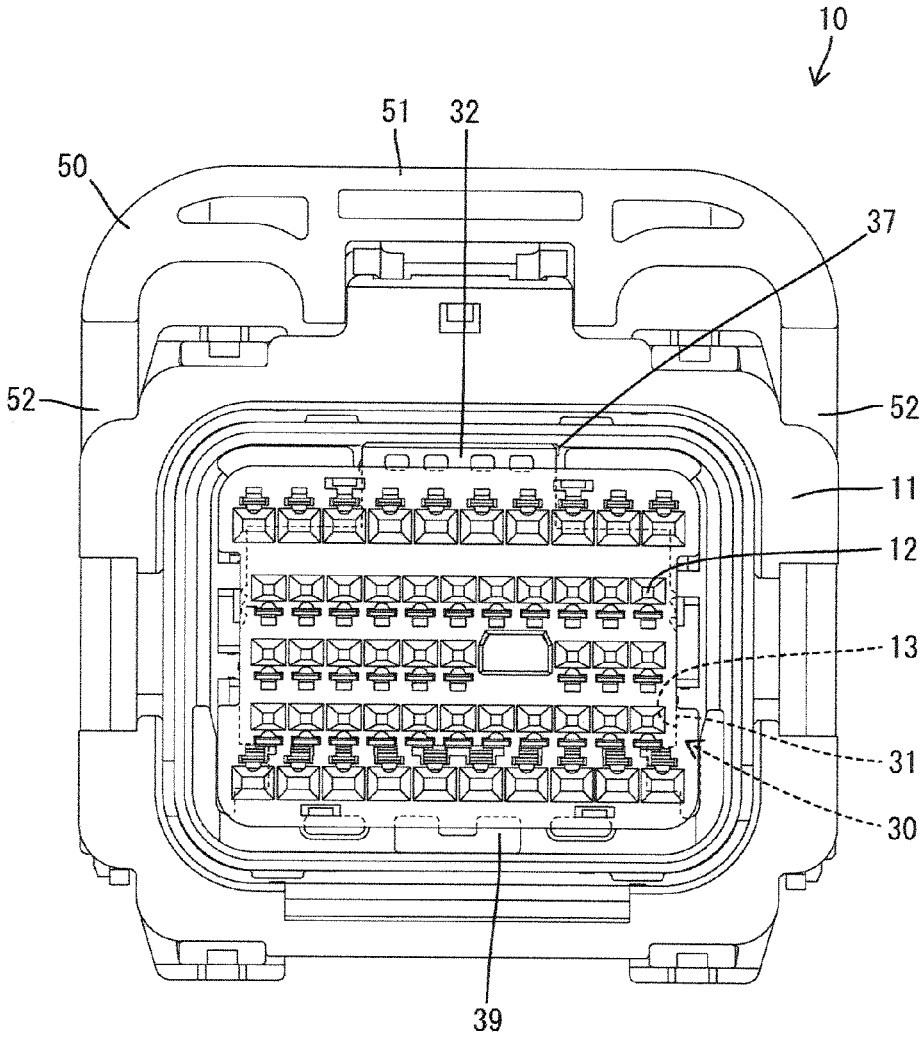
FIG. 1 is a front view of a connector in accordance with an embodiment of the invention showing a retainer held at a full locking position.
Figure 2:
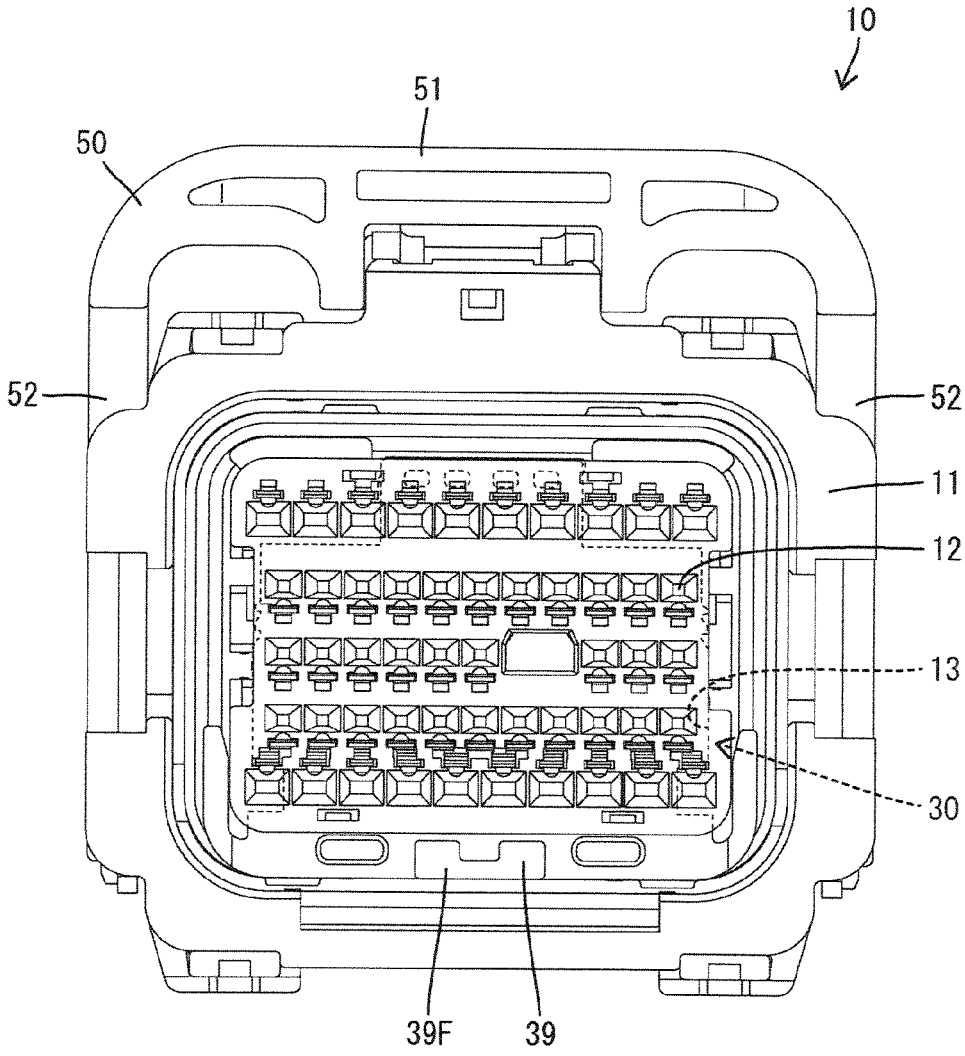
FIG. 2 is a front view of the connector showing the retainer is held at a partial locking position.
Figure 3:
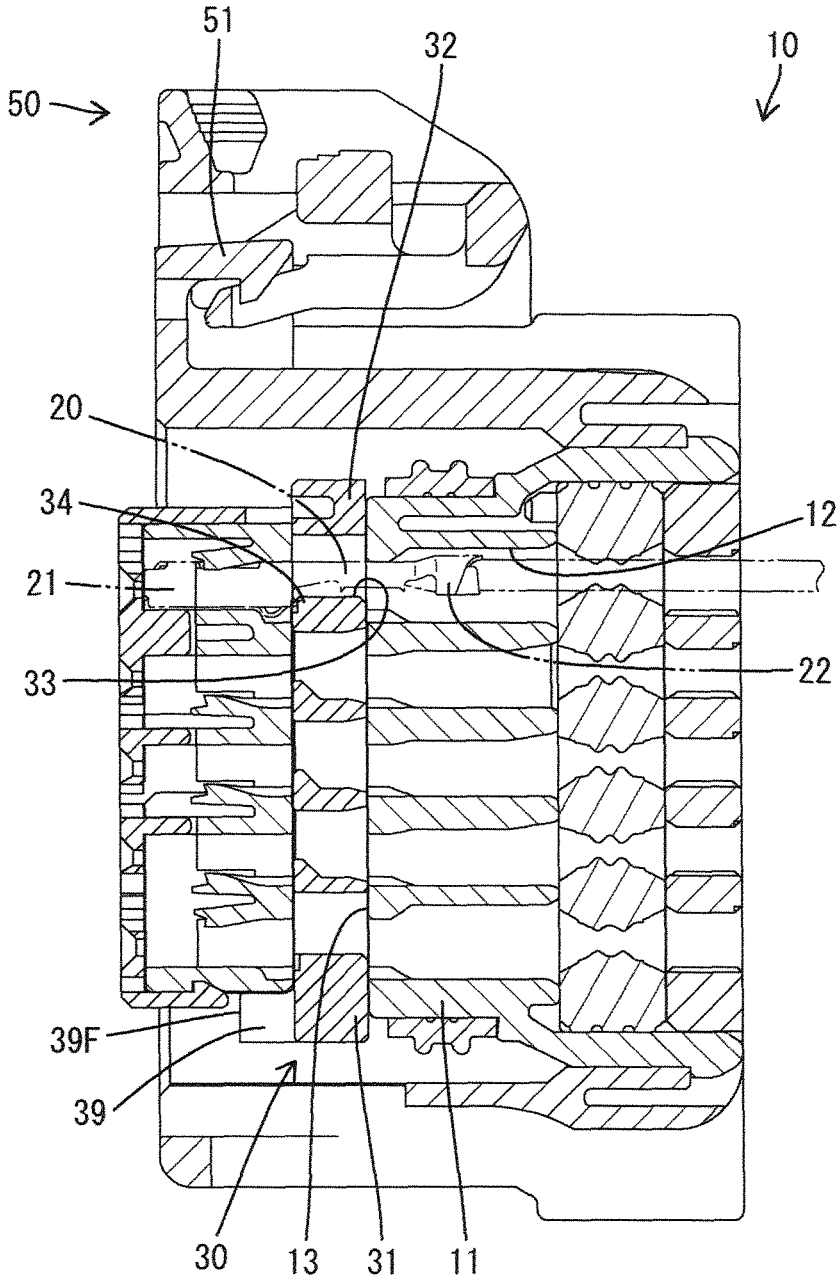
FIG. 3 is a side view in section of the connector showing the retainer held at the full locking position.
Figure 4:
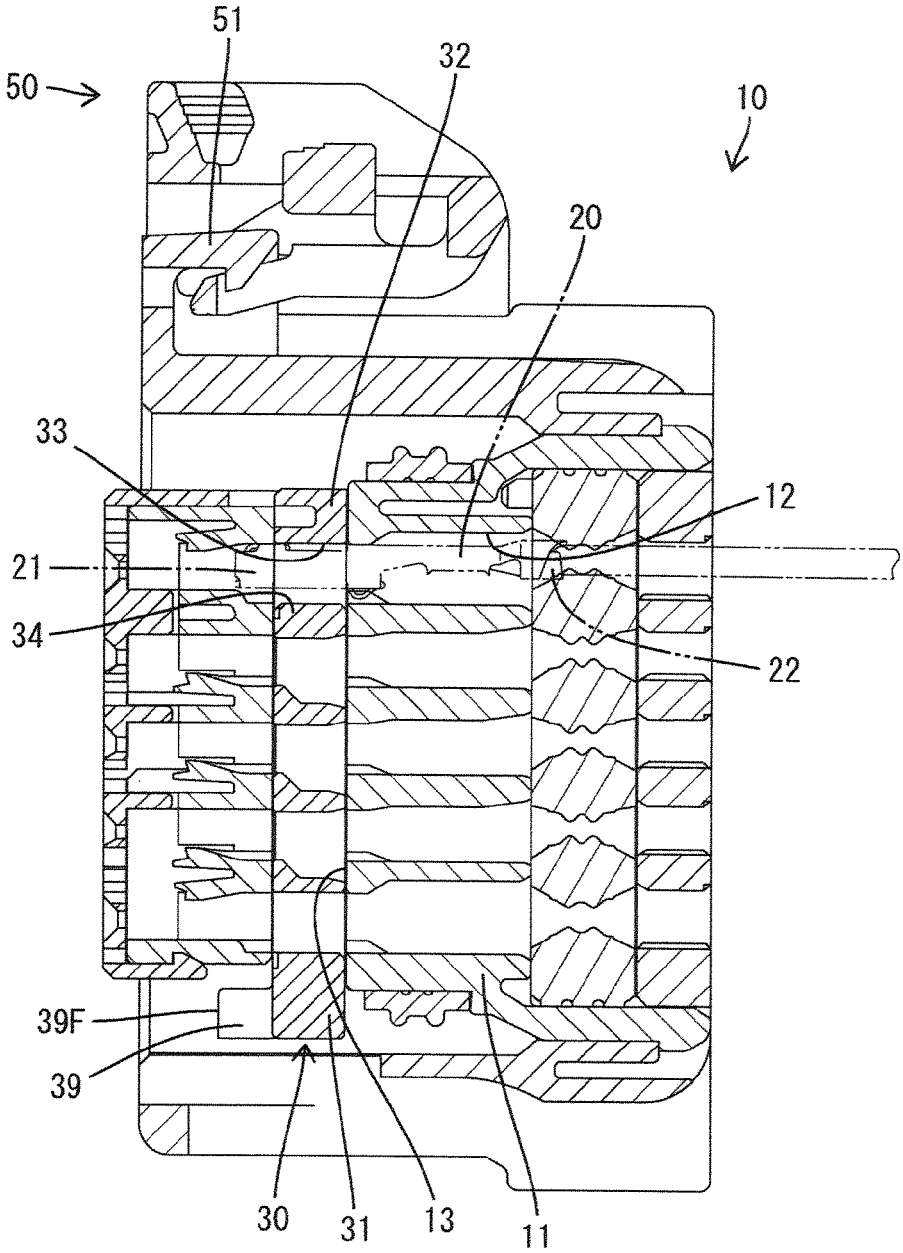
FIG. 4 is a side view in section of the connector showing the retainer held at the partial locking position.

As shown in FIGS. 3 and 4, terminal accommodating chambers 12 penetrate through the housing 11 in forward and backward directions and the terminal fittings 20 are inserted into the terminal accommodating chambers 12 from behind the housing 11. An accommodation space 13 penetrates into the housing 11 in a vertical direction that is perpendicular to an inserting direction of the terminal fittings 20 into the housing 11. The accommodation space 13 is slightly behind the front ends of the terminal accommodating chambers 12 in forward and backward inserting and withdrawing directions of the terminal fittings 20 and communicates with each terminal accommodating chamber 12. The retainer 30 is mounted into the accommodation space 13 from below the housing 11 and is vertically movable between the partial locking position and the full locking position. A moving direction from the partial locking position to the full locking position is up.

Figure 5:
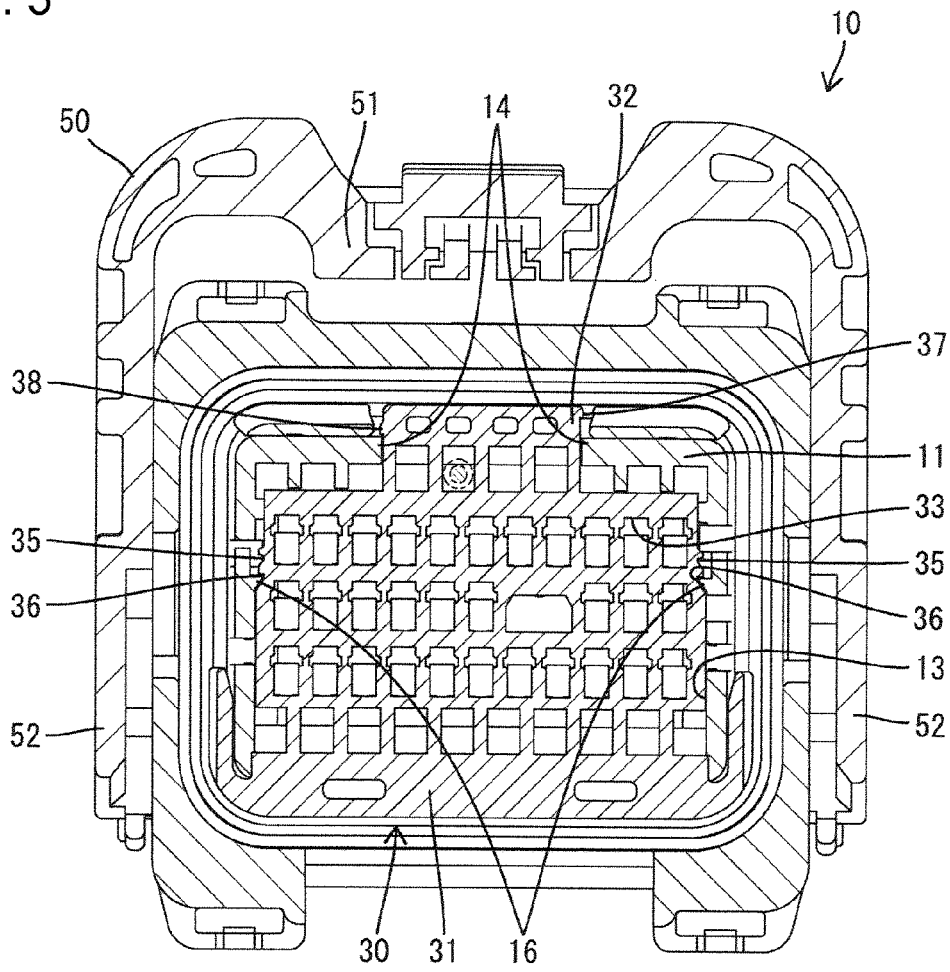
FIG. 5 is a front view in section of the connector showing the retainer held at the full locking position.

As shown in FIG. 5, an opening of the accommodation space 13 on the lower surface of the housing 11 extends over substantially the entire width of the housing 11 in a lateral direction that is perpendicular to both the inserting direction of the terminal fittings 20 into the housing 11 and the moving direction of the retainer 30. On the other hand, an opening of the accommodation space 13 on the upper surface of the housing 11 is in a substantially center area of the housing 11 and is narrower in the lateral direction than the opening on the lower surface.

Figure 6:
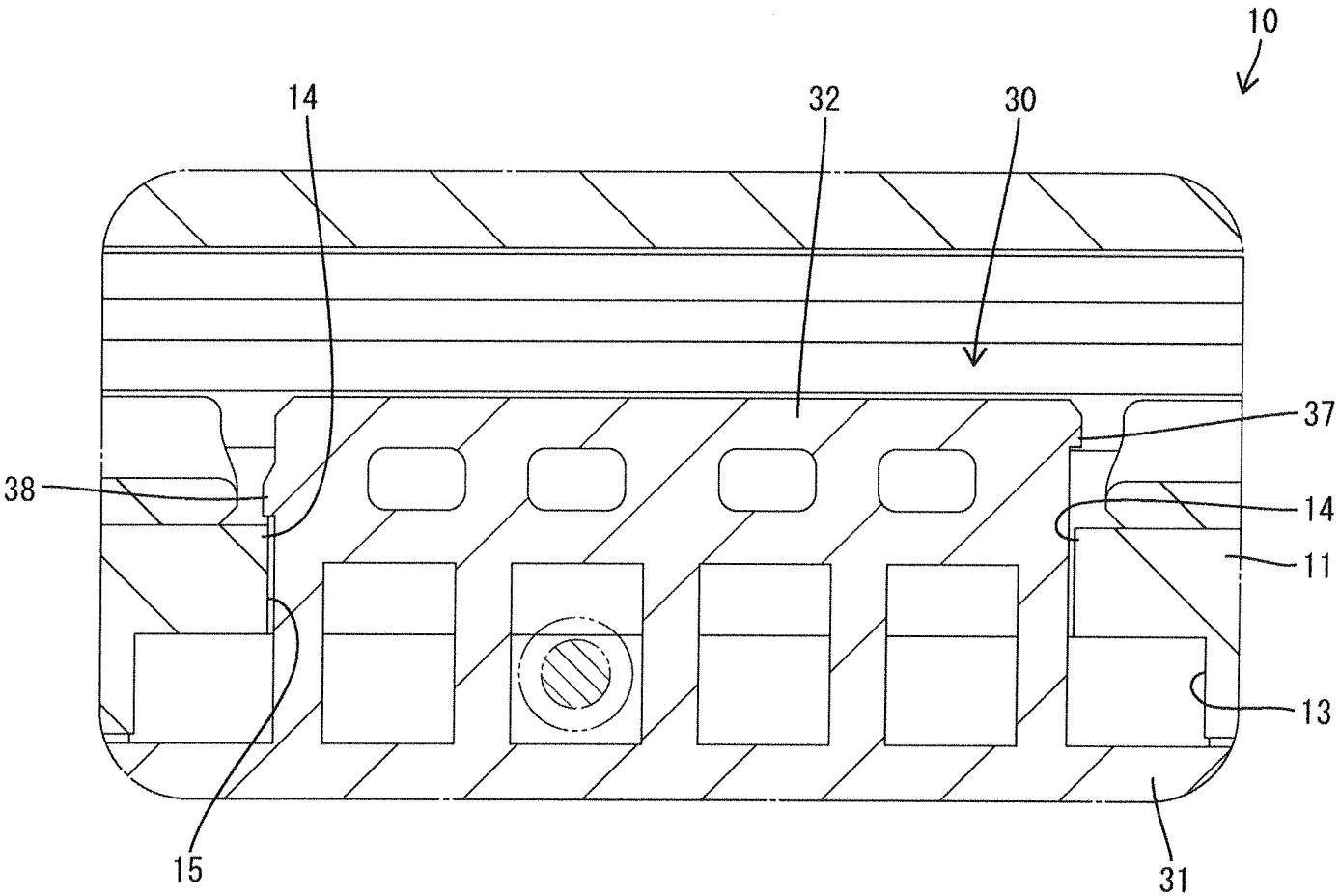
FIG. 6 is a partial enlarged front view in section of the connector showing the retainer is held at the full locking position.
Figure 7:
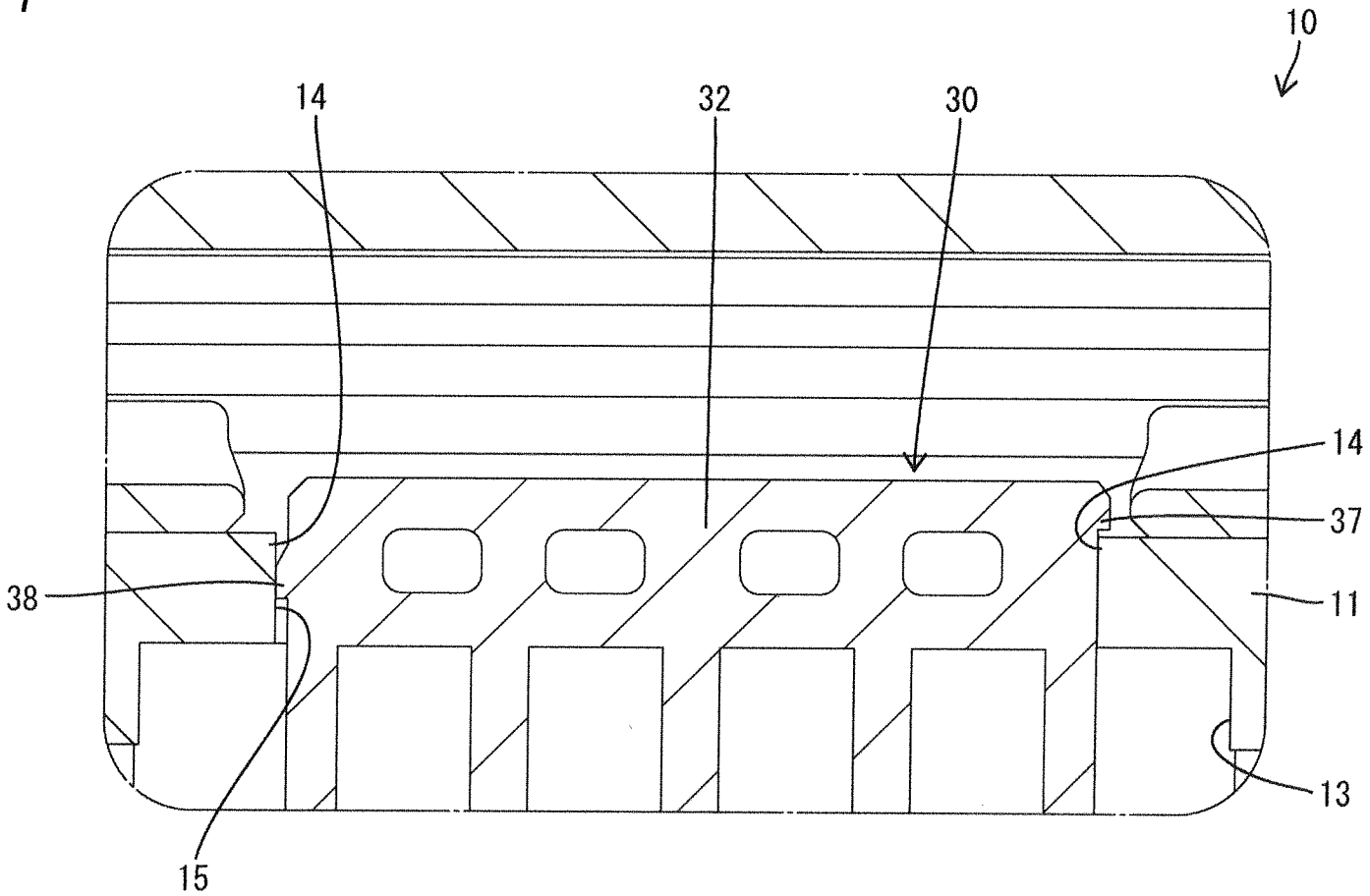
FIG. 7 is a partial enlarged front view in section of the connector showing the retainer held at the partial locking position.

As shown in FIGS. 5 to 7, the opening of the accommodation space 13 on the upper surface of the housing 11 includes left and right locking edges 14 to engage with a partial locking projection 37 and a full locking projection 38 of the retainer 30. A pressure receiving surface 15 is defined on an upper part of a left inner surface of the accommodation space 13 when viewed from the front, as shown in FIGS. 6 and 7. The pressure receiving surface 15 is substantially flat and substantially parallel to the moving direction of the retainer 30. Left and right locking claws 16 project at positions of the left and right inner surfaces of the accommodation space 13 below the pressure receiving surface 15, as shown in FIG. 5.

Figure 10:
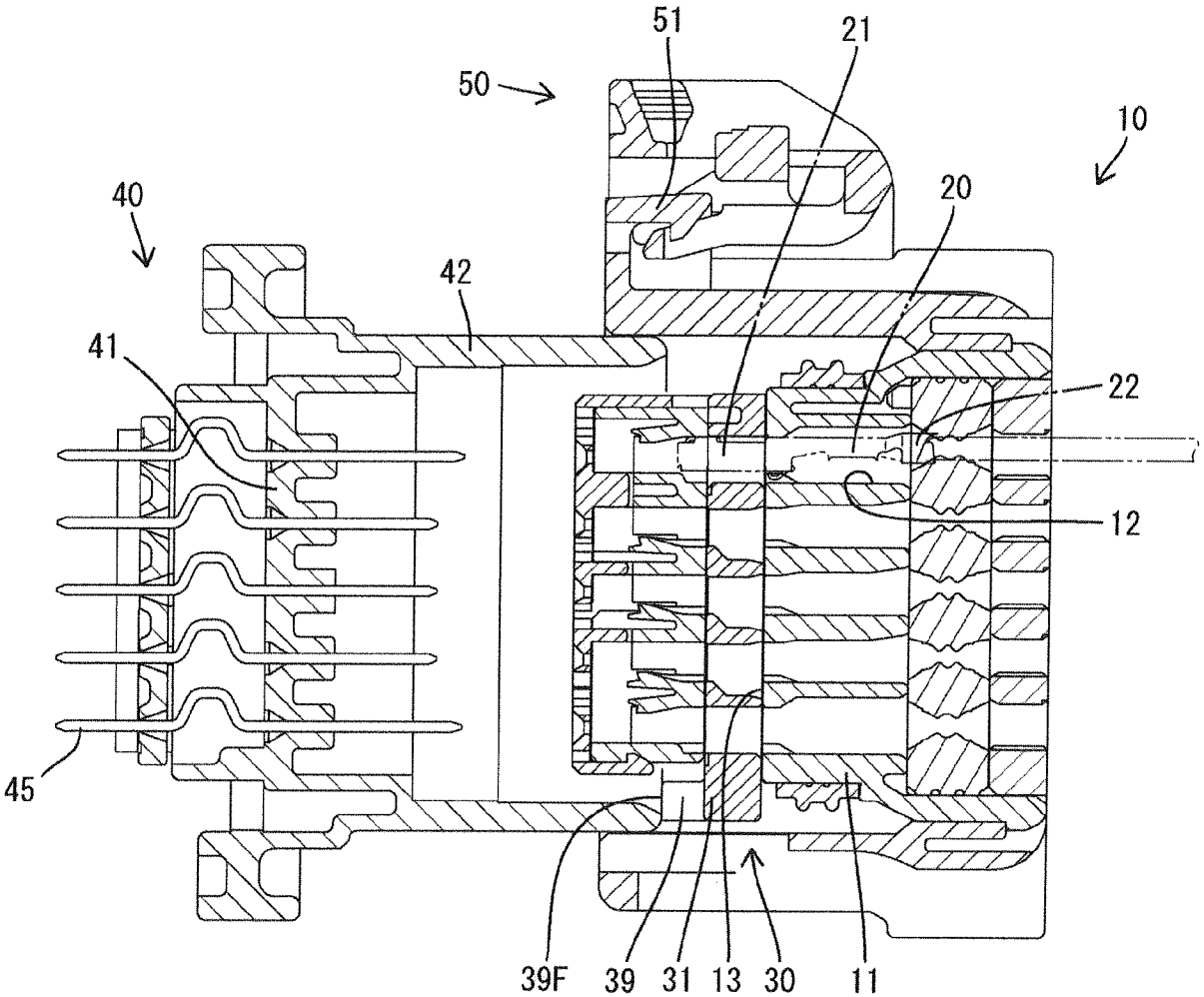
FIG. 10 is a side view in section showing a connection process of the connector with a board-side connector while the retainer is at the partial locking position.

The terminal fitting 20 is long and narrow in forward and backward directions, as shown in FIGS. 3, 4 and 10. A rectangular tube 21 is formed at a front end part of the terminal fitting 20 for connecting to a mating tab-shaped terminal 45, and a wire connecting portion 22 is formed at the rear end of the terminal fitting 20.

Figure 8:
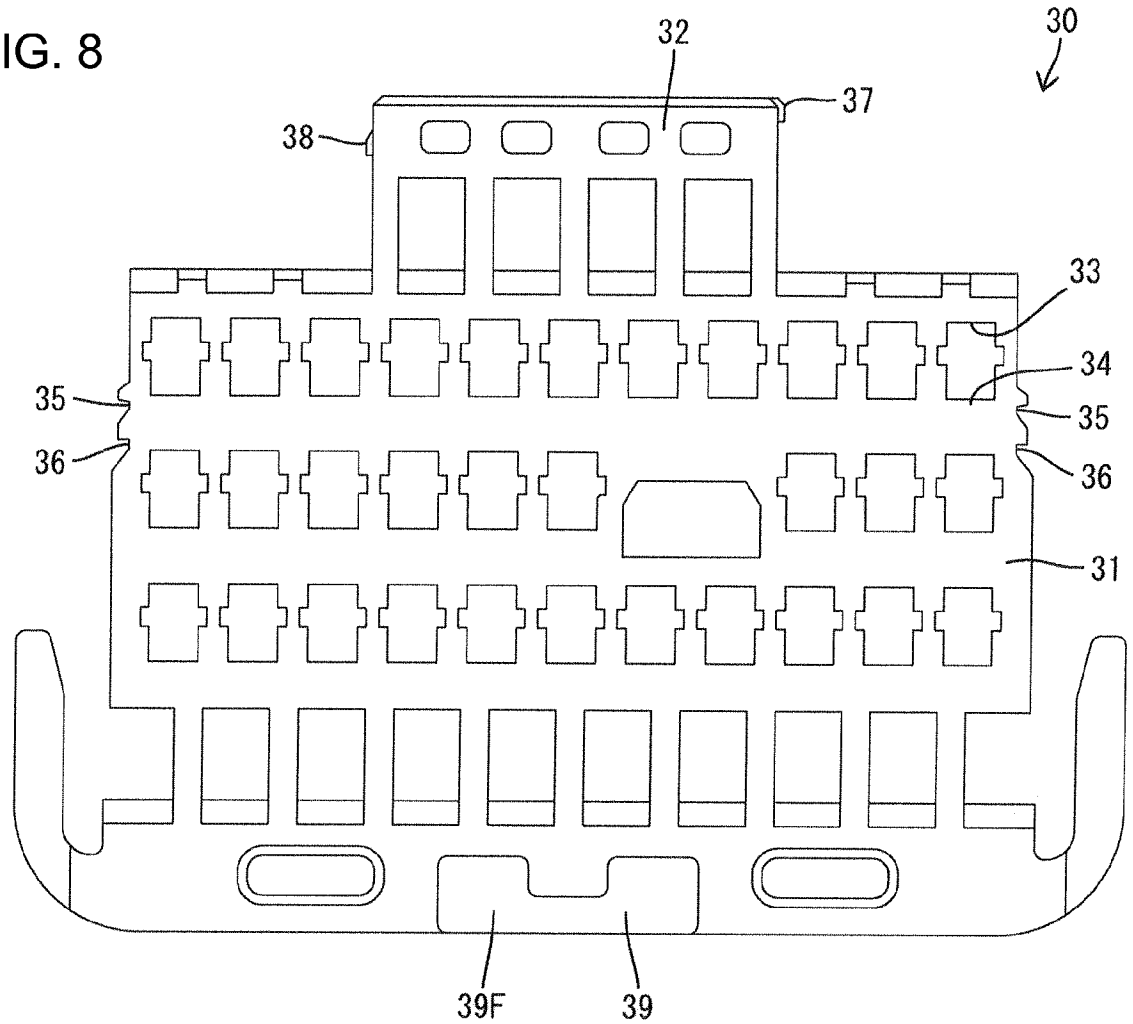
FIG. 8 is a front view of the retainer.
Figure 9:
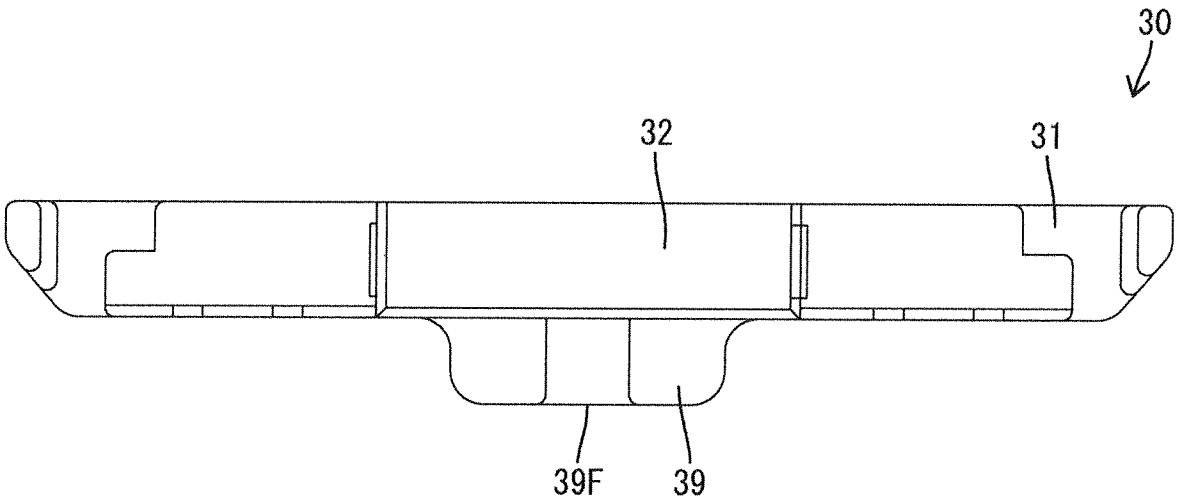
FIG. 9 is a plan view of the retainer.

The retainer 30 is formed unitarily to include a main body 31 having a substantially rectangular front shape and a narrow portion 32 projecting up from the upper surface of the main body 31, as shown in FIG. 8. Through holes 33 penetrate the main body 31 in forward and backward directions. A retaining portion 34 is formed at the opening edge of each through hole 33 and is engageable with the rear end of the rectangular tube 21 of the terminal fitting 20. Left and right partial locking recesses 35 are formed on the left and right outer surfaces of the main body 31 and left and right full locking recesses 36 arranged at lower positions than the partial locking recesses 35.

The partial locking projection 37 is formed on the right outer surface out of the narrow portion 32 when viewed from the front, as shown in FIGS. 6 to 8. The partial locking projection 37 is formed at an upper end part of the narrow portion 32 in the vertical moving direction of the retainer 30. On the other hand, the full locking projection 38 is formed on the left outer surface of the narrow portion 32. The full locking projection 38 is formed at a position near the upper end of the narrow portion 32 and lower than the partial locking projection 37 in the vertical direction.

Opening areas of the through holes 33 substantially align with the terminal accommodating chambers 12 and the retaining portions 34 are retracted down from insertion paths for the terminal fittings 20 in the terminal accommodating chambers 12 when the retainer 30 is at the partial locking position shown in FIG. 4. Thus, the terminal fittings 20 can be inserted into the terminal accommodating chambers 12. The lower surface of the retainer 30 at the partial locking position can be pushed up to move the retainer 30 up to the full locking position. Thus, the retaining portions 34 enter the terminal accommodating chambers 12 and engage with the rear end edges of the rectangular tubes 21 of the terminal fittings 21 from behind. Accordingly, the retainer 30 holds and retains the terminal fittings 20.

The retainer 30 is mounted into the housing 11 and held at the partial locking projection at a factory different from a site where the terminal fittings 20 are inserted into the housing 11. As shown in FIGS. 5 and 7, the means for holding the retainer 30 at the partial locking position include: a first locking structure defined by the partial locking recesses 35 and the locking claws 16; a second locking structure defined by the partial locking projection 37 and the locking edge 14; and a pressing structure defined by the full locking projection 38 pressing the pressure receiving surface 15. The first locking structure creates a mechanical engagement between the partial locking recesses 35 and the locking claws 16 in the direction of movement of the retainer 30 from the partial locking position to the full locking position. The second locking structure also creates a mechanical engagement between the partial locking projection 37 and the locking edge 14 in the direction of movement of the retainer 30 from the partial locking position to the full locking position.

On the other hand, the pressing structure defined by the full locking projection 38 and the pressure receiving surface 15 creates a pressing force in directions perpendicular to the moving direction of the retainer 30 from the partial locking position to the full locking position. More particularly, an outer side surface of the narrow portion 32 opposite to the pressure receiving surface 15 is pressed strongly against the inner side surface of the accommodation space 13 of the housing 11. As a result, the narrow portion 32 is secured in the accommodation space 13 in a lateral direction perpendicular to the moving direction of the retainer 30, thereby creating a frictional resistance that restricts movement of the retainer 30 from the partial locking position to the full locking position.

The first and second locking structures and the pressing structure reliably hold the retainer 30 at the partial locking position and restrict movement to the full locking position. More particularly, the connector 10 includes the pressing means defined by the full locking projection 38 and the pressure receiving surface 15 in addition to locking means defined by the partial locking recesses 35 and the locking claws 16 to ensure an excellent holding force for holding the retainer 30 at the partial locking position.

The terminal fittings 20 are inserted into the housing 11 with the retainer 30 at the partial locking position. A pushing force then is applied to the lower surface of the retainer 30 at the partial locking position to push up the retainer 30 to the full locking position. The pushing force must exceed a holding force that is a sum of a locking force exerted by the partial locking recesses 35 and the locking claws 16 and the frictional resistance exerted by the full locking projection 38 and the pressure receiving surface 15. The locking action of the full locking recesses 36 and the locking claws 16 holds the retainer 30 at the full locking position, as shown in FIG. 5. Further, as shown in FIG. 6, the full locking projection 38 engages the locking edge 14 to restrict a return movement of the retainer 30 to the partial locking position.

The pressing means of the retainer 30 for restricting movement from the partial locking position is the full locking projection 38, which is engageable with the housing 11 to hold the retainer 30 at the full locking position. Thus, the pressing means of the retainer 30 performs two functions. As a result, the retainer 30 has a simpler shape than a retainer with a dedicated means for holding the retainer at the full locking position in addition to the pressing means.

The retainer 30 has the main body 31 and the narrow portion 32. The main body 31 has the retaining portions 34 for engaging and holding the terminal fittings 20. The narrow portion 32 is formed with the full locking projection 38 and is narrower than the main portion 31 in directions substantially parallel to the pressing forces between the full locking projection 38 and pressure receiving surface 15. The smaller width of the narrow portion 32 results in less deformation in response to lateral pressing forces. This smaller deformation results in higher frictional resistance between the full locking projection 38 and the pressure receiving surface 15 as compared with a case where the full locking projection is formed on the main portion. Therefore, the retainer 30 is held at the full locking position with a larger force.

Figure 11:
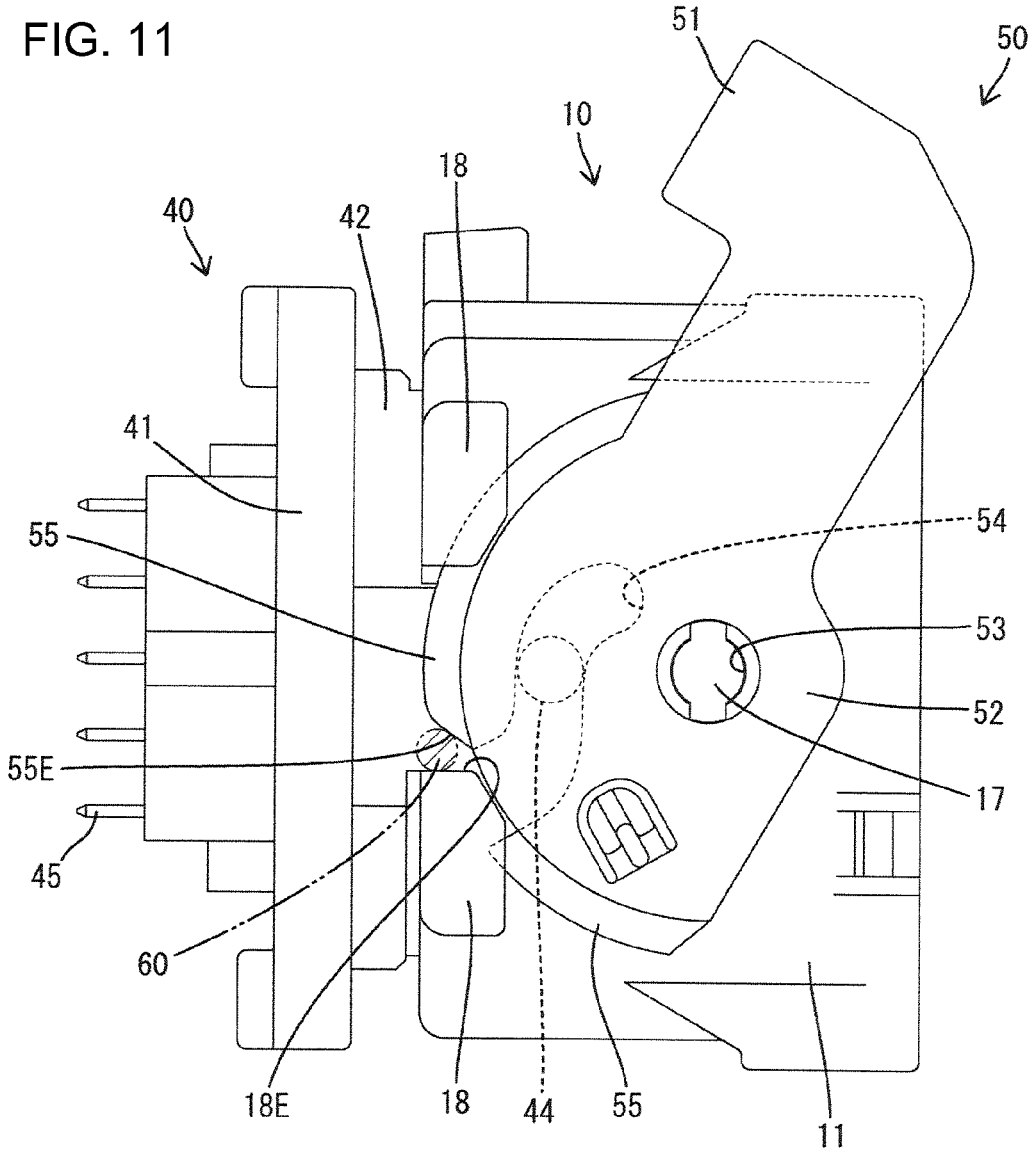
FIG. 11 is a side view showing a state where external matter is caught between a restricting edge of a lever and an opening prevention wall of a housing during rotation of the lever.
Figure 12:
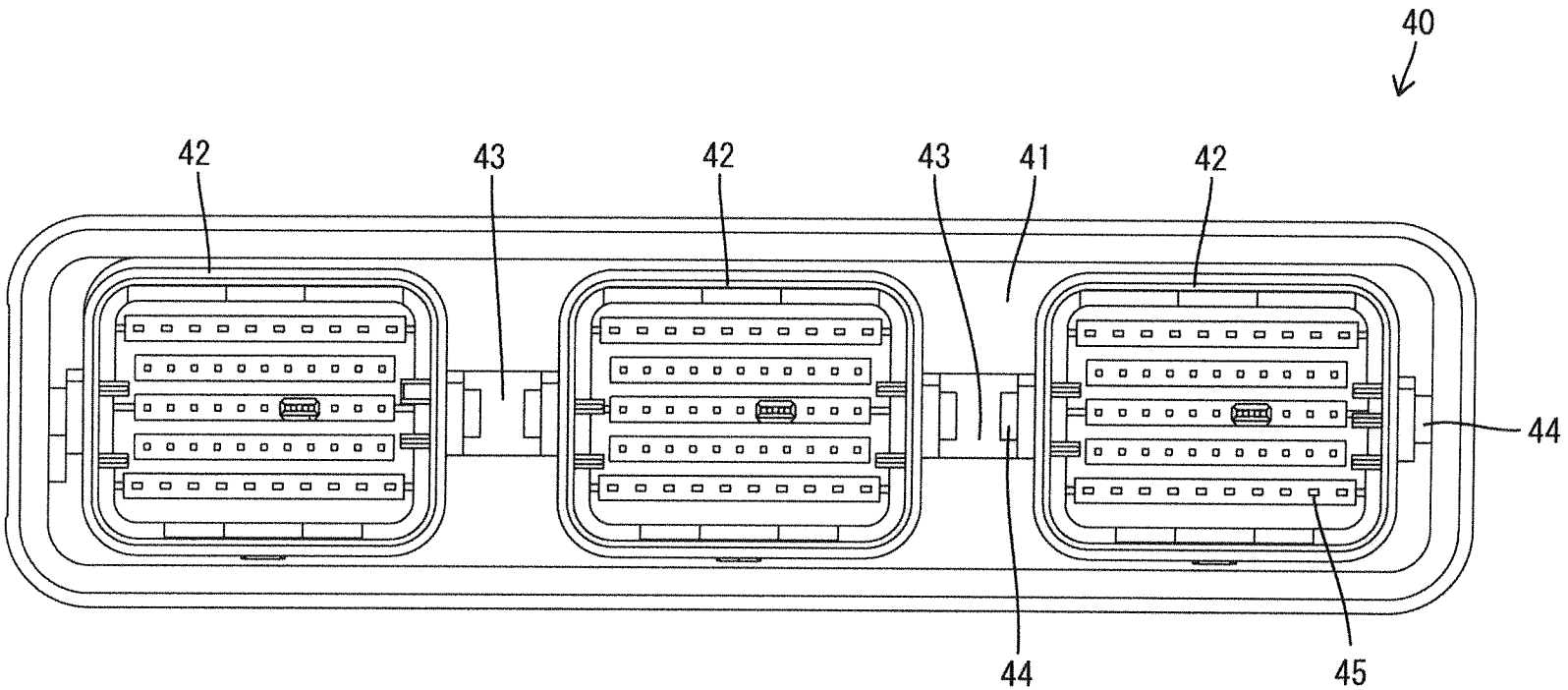
FIG. 12 is a front view of the board-side connector.
Figure 13:
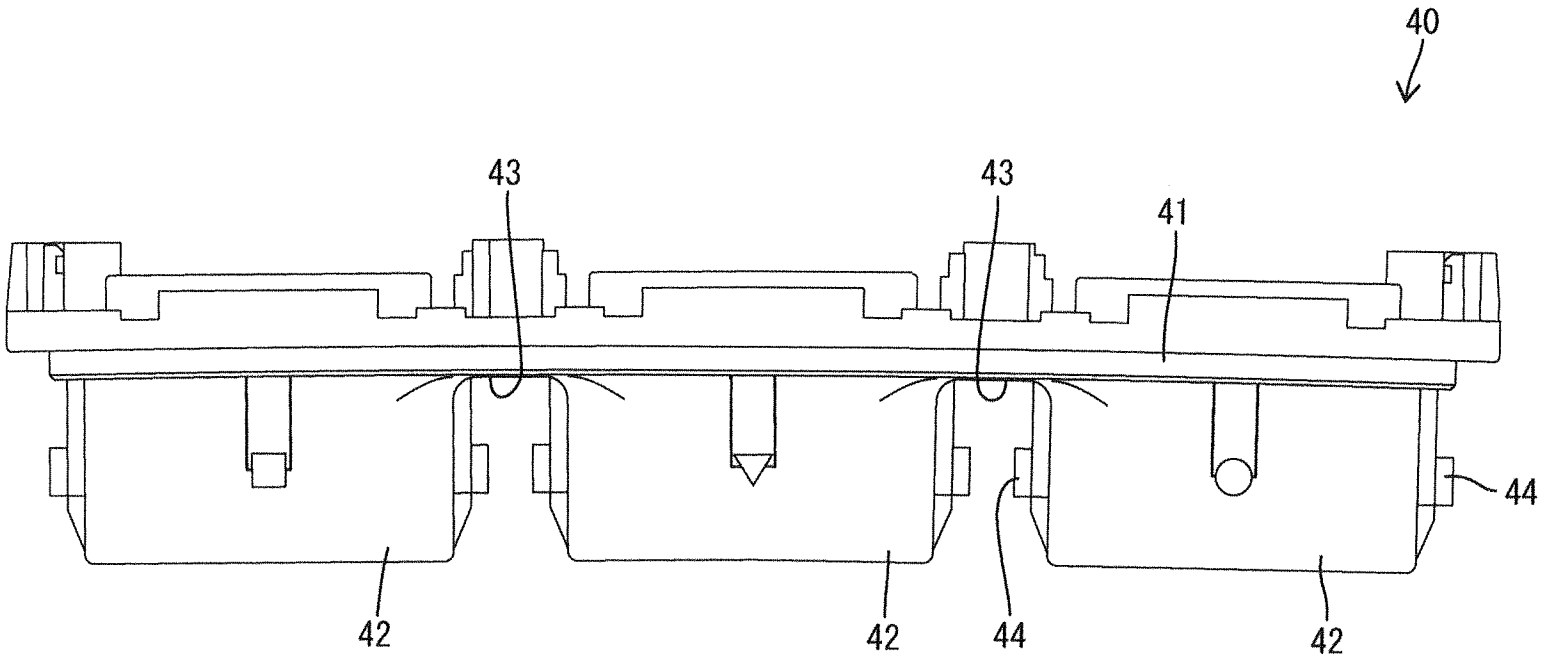
FIG. 13 is a plan view of the board-side connector.

The connector 10 is to be connected to a board-side connector 40, as shown in FIGS. 10 to 13. The board-side connector 40 has a wide rectangular base plate 41, rectangular tubular receptacles 42 projecting forward from the base plate 41, and tab-shaped terminals 45 penetrating through the base plate 41. As shown in FIGS. 12 and 13, reinforcing ribs 43 are formed on the front surface of the base plate 41 and extend laterally to link the outer surfaces of the adjacent receptacles 42. The ribs 43 enhance the rigidity of the base plate 41 so that the base plate 41 will not deform in forward and backward directions.

The connector 10 is fit into each receptacle 42. As shown in FIG. 10, a detecting portion 39 projects forward from a lower part of the main body 31 of the retainer 30 and projects a large distance from the lower surface of the housing 11 when the retainer 30 is at the partial locking position. A projecting distance of the detecting portion 39 from the housing 11 decreases when the retainer 30 moves to the full locking position. Thus, the connector 10 can be fit into the receptacle 42 without any problem when the retainer 30 is pushed to the full locking position. However, the detecting portion 39 will interfere with the front end edge of the receptacle 42 when the retainer 30 is left at the partial locking position, as shown in FIG. 10, thereby preventing the connector 10 from being fit into the receptacle 42 of the board-side connector 40.

The detecting portion enables a determination of whether the retainer 30 is at the partial locking position or the full locking position. However, the retainer 30 could be left at an intermediate position between the partial locking position and the full locking position. Accordingly, there is a concern that the lower wall of the receptacle 42 may deform down and the detecting portion 39 may be forced into the receptacle 42. However, the detecting portion 39 has a flat front end surface 39F that faces the receptacle 42 during the connecting operation and is perpendicular to a connecting direction over the entire area thereof. The front end surface 39F of the detecting portion 39 reliably interferes with the front end of the receptacle 42 when the retainer 30 is not at the full locking position, thereby reliably detecting whether the retainer 30 is at the full locking position.

A lever 50 is provided on the connector 10, as shown in FIG. 11, and is used during connection with the board-side connector 40. This lever 50 has an operating portion 51 and two plate-like arms 52 extend from left and right ends of the operating portion 51. The arms 52 have bearing holes 53 that are mounted rotatably on support shafts 17 of the connector 10. A cam groove 54 extends from the outer peripheral edge of each arm 52, and left and right cam followers 44 project from each receptacle 42 of the board-side connector 40, as shown in FIGS. 12 and 13. The cam followers 44 move along the cam grooves 54 as the lever 50 is rotated and draw the connector 10 and the board-side connector 40 together.

Forces exerted on the cam followers 44 and the cam grooves 54 in the connection process urge the arms 52 away from one another and away from the outer side surfaces of the housing 11. As a result the cam grooves 54 may disengage from the cam followers 44. Accordingly, as shown in FIG. 11, a restricting edge 55 bulges out from the outer peripheral edge of each arm 52, and upper and lower opening prevention walls 18 are formed on the left and right outer surfaces of the housing 11 to face the outer surfaces of the restricting edges 55. The opening prevention walls 18 engage the restricting edges 55 to prevent opening deformations of the arms 52.

There is a concern that external matter 60, such as a wire, may be caught between a lower end 55E of the upper restricting edge 55 and an upper end 18E of the lower opening prevention wall 18, as shown in FIG. 11. Accordingly, the lower end 55E of the upper restricting edge 55 is formed oblique to the upper end 18E of the lower opening prevention wall 18 when approaching the upper end 18E of the lower opening prevention wall 18. Thus, external matter 60 that is pushed forward from the space between the lower end 55E of the upper restricting edge 55 and the upper end 18E of the lower opening prevention wall 18 as the lever 50 is rotated and will not be caught between the upper restricting edge 55 and the lower opening prevention wall 18.

The invention is not limited to the above described embodiment. For example, the following embodiments also are included in the scope of the invention.

The pressing means of the above-described retainer also has the function of holding the retainer at the full locking position. However, a dedicated means for holding the retainer at the full locking position may be provided in addition to the pressing means.

Although the pressing means (full locking projection) of the retainer is formed on the narrow portion having a smaller width than the main portion in the above embodiment, it may be formed on the main portion.

What is claimed is:

1. A connector, comprising:

a housing;

at least one terminal fitting to be inserted into the housing;

a retainer mounted in the housing at a partial locking position for permitting insertion of the terminal fitting into the housing and movable to a full locking position for retaining the terminal fitting in the housing;

locking means formed on the housing and the retainer and engageable with one another for holding the retainer at the partial locking position; and pressing means formed on the housing and the retainer and pressing against each other in directions intersecting a moving direction of the retainer from the partial locking position to the full locking position when the retainer is at the partial locking position for restricting a movement of the retainer toward the full locking position.

2. The connector of claim 1, wherein the pressing means comprises a full locking projection on the retainer, the full locking projection being configured to engage the housing to hold the retainer at the full locking position.

3. The connector of claim 2, wherein the retainer has a main body with at least one retaining portion for engaging the terminal fitting and retaining the terminal fitting in the housing, a narrow portion projecting from the main body and having a smaller width than the main body in a direction substantially parallel to pressing directions of the pressing means, at least part of the pressing means being formed on the narrow portion.

4. The connector of claim 3, wherein the locking means comprises a first locking structure defined by at least one partial locking recess on the main body of the retainer and at least one locking claw on the housing and a second locking structure defined by a partial locking projection on the narrow portion of the retainer and a locking edge on the housing.

5. The connector of claim 4, wherein the partial locking projection is on a side of the narrow portion of the retainer, and wherein the part of the pressing means formed on the narrow portion is on a side of the narrow portion opposite the locking projection.

6. The connector of claim 1, wherein the housing is made of synthetic resin.

7. The connector of claim 1, wherein the retainer is made of synthetic resin.

8. A connector, comprising:

a housing;

at least one terminal fitting to be inserted into the housing;

a retainer mounted in the housing at a partial locking position for permitting insertion of the terminal fitting into the housing and movable to a full locking position for retaining the terminal fitting in the housing;

at least one locking structure formed on the housing and at least one mating locking structure formed on the retainer, the locking structure and the mating locking structure being engageable with one another along a moving direction of the retainer from the partial locking position to the full locking position for holding the retainer at the partial locking position; and a projection formed on the retainer and configured for pressing against a surface of the housing in a pressing direction intersecting a moving direction of the retainer from the partial locking position to the full locking position when the retainer is at the partial locking position for restricting a movement of the retainer toward the full locking position.

9. The connector of claim 8, wherein the projection is a full locking projection configured to engage the housing along a moving direction of the retainer from the full locking position to the partial locking position for holding the retainer at the full locking position.

10. The connector of claim 8, wherein the retainer has a main body with at least one retaining portion for engaging the terminal fitting and retaining the terminal fitting in the housing, a narrow portion projecting from the main body and having a smaller width than the main body in a direction substantially parallel to the pressing direction of the projection, the projection being formed on the narrow portion.

11. The connector of claim 10, wherein the at least one locking structure on the housing comprises at least one locking claw and a locking edge, and wherein the at least one mating locking structure comprises at least one partial locking recess on the main body of the retainer that engages the locking claw on the housing when the retainer is at the partial locking position and a partial locking projection on the narrow portion of the retainer that engages locking edge on the housing when the retainer is at the partial locking position.

12. The connector of claim 11, wherein the partial locking projection is on a side of the narrow portion of the retainer and the projection is on a side of the narrow portion opposite the locking projection.

* * * * *